US006534473B1

(12) United States Patent
Appel et al.

(10) Patent No.: US 6,534,473 B1
(45) Date of Patent: Mar. 18, 2003

(54) PROCESS FOR THE MANUFACTURE OF TABLET DETERGENT COMPOSITIONS

(75) Inventors: Peter Willem Appel, Vlaardingen (NL); Jelles Vincent Boskamp, Vlaardingen (NL); James William Gordon, Cumbria (GB); Marcel Van der Kraan, Vlaardingen (NL); Edwin Leo Lempers, Vlaardingen (NL); Henning Wagner, Vlaardingen (NL)

(73) Assignee: Unilever Patent Holdings BV, Vlaardingen (NL)

( * ) Notice: Subject to any disclaimer, the term of this patent is extended or adjusted under 35 U.S.C. 154(b) by 0 days.

(21) Appl. No.: 09/601,959

(22) PCT Filed: Feb. 4, 1999

(86) PCT No.: PCT/EP99/00749

§ 371 (c)(1),
(2), (4) Date: Oct. 2, 2000

(87) PCT Pub. No.: WO99/41353

PCT Pub. Date: Aug. 19, 1999

(30) Foreign Application Priority Data

Feb. 10, 1998 (GB) ..... 9802850
Mar. 5, 1998 (GB) ..... 9804713

(51) Int. Cl.[7] ..... C11D 11/00; C11D 17/00
(52) U.S. Cl. ..... 510/446; 510/294; 510/298
(58) Field of Search ..... 510/294, 298, 510/446, 510, 512

(56) References Cited

U.S. PATENT DOCUMENTS

| | | | | |
|---|---|---|---|---|
| 3,081,267 A | | 3/1963 | Laskey | 252/135 |
| 3,324,038 A | | 6/1967 | Chaffee et al. | 252/152 |
| 3,370,015 A | | 2/1968 | van Kampen et al. | 252/137 |
| 3,451,928 A | | 6/1969 | Fischer | 252/135 |
| 3,953,350 A | | 4/1976 | Fujino et al. | 252/94 |
| 5,225,100 A | * | 7/1993 | Fry et al. | 510/298 |
| 5,914,309 A | * | 6/1999 | Ulbl et al. | 510/446 |
| 6,066,615 A | | 5/2000 | Bijl et al. | 510/446 |
| 6,083,895 A | * | 7/2000 | Warwick | 510/224 |
| 6,372,707 B1 | * | 4/2002 | Boskamp et al. | 510/440 |

FOREIGN PATENT DOCUMENTS

| | | | |
|---|---|---|---|
| DE | 1 271 884 | | 7/1968 |
| EP | 0 481 792 A1 | | 4/1992 |
| EP | 0 481 793 A1 | | 4/1992 |
| EP | 0 522 766 A2 | | 1/1993 |
| EP | 0 711 827 A2 | | 5/1996 |
| EP | 0711827 | | 5/1996 |
| EP | 0838519 A1 | * | 4/1998 |
| EP | 0839906 A1 | * | 5/1998 |
| GB | 911204 | | 11/1962 |
| GB | 1004596 | | 9/1965 |
| WO | WO-96/23053 A1 | * | 8/1996 |

OTHER PUBLICATIONS

Derwent Abstract, JP 06–015500, Jan. 26, 1985.

* cited by examiner

*Primary Examiner*—Lorna M. Douyon
(74) *Attorney, Agent, or Firm*—Morgan, Lewis & Bockius LLP

(57) ABSTRACT

Detergent tablets for use in fabric washing are made by mixing: (i) particles which contain non-soap organic surfactant and other materials, especially detergency builder, with (ii) material which is other than soap or organic surfactant and which has a solubility in water of at least 10 gm/liter at 20° C., followed by compacting the mixture into a tablet or a region of a tablet using an applied pressure in a range from 3.0 to 35 MPa. Such a pressure, used with the specified mixture, leads to tablets with good strength which also disintegrates with satisfactory speed.

10 Claims, 2 Drawing Sheets

PROCESS FOR THE MANUFACTURE OF TABLET DETERGENT COMPOSITIONS

This invention relates to detergent compositions in the form of tablets for use in fabric washing.

Detergent compositions in tablet form have been described in, for example, GB 911204 (Unilever), U.S. Pat. No. 3,953,350 (Kao), JP 60-015500A (Lion), and EP-A-711827 (Unilever) and are sold commercially in Spain. Tablets have several advantages over powdered products: they do not require measuring and are thus easier to handle and dispense into the washload, and they are more compact, hence facilitating more economical storage.

Such tablets are generally made by compressing or compacting a quantity of detergent composition in particulate form. It is desirable that tablets should have adequate mechanical strength when dry, before use, yet disintegrate and disperse/dissolve quickly when added to wash water. It has not proved simple to achieve both properties simultaneously. As more pressure is used when a tablet is compacted, so the tablet density and strength rise, but the speed of disintegration/dissolution when the tablet comes into contact with wash water goes down.

During the period from about 1960 to 1970 there was considerable research activity in connection with tablets for use in fabric washing. A number of patents were published by major detergent manufacturers. Detergent tablets were sold commercially in USA and some European countries.

However, tablets disappeared from the market place in nearly all countries (Spain is the apparent exception) even though tablets have apparent advantages and have become known as a product form for machine dishwashing compositions which are characterised by a low content of organic surfactant.

U.S. Pat. No. 3,081,267 (Procter & Gamble) taught that the force, and hence pressure, applied when compacting a composition into tablets should be limited, or else the tablets would take too long to dissolve.

The compression pressure used in the Examples of this document was from 180 to 300 psi (approximately 1.2 to 2.1 MPa). Elsewhere in the document it is proposed that the pressure should not exceed 350 psi (approximately 2.5 MPa) to avoid slow disintegration encountered with higher pressures.

A number of proposals have been put forward as ways to improve the compromise between conflicting desiderata, but there still remains a desire to improve tablet strength without loss of speed of disintegration and vice versa.

Some documents have proposed surface treatments or coatings to enhance tablet strength. For instance U.S. Pat. No. 3,451,928 (Colgate) stated that the problem of strength versus speed of dissolution remained unsolved, and proposed a treatment of spraying on water, followed by flash heating.

U.S. Pat. No. 3,324,038 (Procter) proposed the application of a coating containing urea.

It is known to include materials whose function is to enhance disintegration of tablets when placed in wash water. Some tablets which are sold commercially incorporate urea for this purpose. Urea has a very high solubility in water exceeding 100 gms per 100 ml water at 20° C. EP-A-711827 teaches the use of sodium citrate for the same purpose.

Detergent compositions, including tablet compositions, frequently contain a mixture of anionic and nonionic organic surfactants. It is often desirable to include both of these types of surfactant, for performance of the composition when washing fabrics.

We have now found that by using certain ingredients and formulation ranges for a tablet composition, it is possible to compact a tablet using a pressure somewhat higher than has frequently been described in prior proposals, and obtain tablets with improved strength which disintegrate and dissolve with satisfactory rapidity.

At the same time it is possible to incorporate materials which are desired to give good washing performance, and it is possible to formulate component ingredients of the tablet so that they are satisfactory in handling during tablet manufacture.

Broadly, the present invention provides a process for the manufacture of a detergent tablet which comprises mixing (i) particles which contain non-soap organic surfactant and other materials with (ii) material which is other than soap or organic surfactant and which has a solubility in water of at least 10 gm/liter at 20° C., followed by compacting the mixture into a tablet or a region of a tablet using an applied pressure in a range from 3.0 to 35 MPa.

In a second aspect, the invention provides a tablet obtainable by such a process.

The particles (i) may provide from 25 to 85% of the mixture, but preferably from 30 to 65% by weight of the mixture, and in certain forms of the invention from 41 to 53, 56 or 60% by weight of the mixture.

In this invention, we have found it desirable to incorporate most (if not all) of the surfactants in the particles (i) which constitute a substantial part but by no means all the composition of a tablet. The organic surfactant in these particles desirably provides a substantial part, but again by no means all, of their weight. Preferably the particles also contain detergency builder.

Secondly, it is desirable that the surfactant is a mixture of non-soap anionic and nonionic detergent surfactants (preferably accompanied by soap) where both are present in significant amounts, but anionic is in the majority.

In certain forms of this invention, the mixture contains from 30 to 65% by weight of particles (i) which contain from 25 to 80% by weight (of these particles) of water-soluble or water-insoluble detergency builder and from 20 to 50% by weight (of these particles) of non-soap organic surfactant. This surfactant may be anionic and nonionic surfactants in a ratio from 5:1 to 1.5:1.

We have found that two different measures of tablet strength are relevant to properties observed by a consumer. Force to cause fracture is a direct assessment of strength and indicates the tablets' resistance to breakage when handled by a consumer at the time of use. The amount of energy (or mechanical work) put in prior to fracture is a measure of table deformability and is relevant to the tablets' resistance to breakage during transport.

Both properties are relevant to consumers' perception of tablets: consumers will want tablets to be strong enough to handle, to reach them intact, and to disintegrate quickly and fully at the time of use.

We believe that concentrating most or all of the surfactant into surfactant-rich particles, and using a substantial proportion of anionic surfactant is beneficial in providing tablets which have both strength and elasticity, while allowing the remainder of the tablet composition to contain a substantial proportion of water-soluble material which assists disintegration of the tablets at the time of use.

It is not necessary to include surfactant as a binder material in the part of the composition outside the surfactant-rich particles. Excluding it from this part of the composition is advantageous, to avoid interference with the prompt dissolution of this part of the composition.

So, it is preferred that the weight of the non-soap anionic surfactant in the particles (i) is at least 1.7 times the weight of the nonionic surfactant in them. More preferably, this weight ratio of anionic surfactant to nonionic surfactant lies in a range from 2:1 up to 5:1, and more preferably from 2:1 to 4:1. Preferably these particles contain at least 80% by weight better at least 90% or even 95% of all the organic surfactant (including any soap) in the tablet or region.

The material (ii) which is present in the mixture, externally to the surfactant-rich particles, preferably comprises from 15 to 40% (better 16 to 35%) by weight of the mixture of one or more materials selected from compounds with a water-solubility exceeding 50 grams per 100 grams water;

sodium tripolyphosphate containing at least 50% of its own weight of the phase I anhydrous form, and preferably partially hydrated so as to contain water of hydration in an amount which is at least 1% by weight of the sodium tripolyphosphate;

mixtures thereof.

It is strongly preferred that the water-soluble material (ii) which is present in the composition, externally to the surfactant-rich particles (i) is present as particles which are substantially free of surfactant, i.e. contain no more than 5% of their own weight of organic surfactant.

In certain preferred forms of this invention the mixture contains (i) from 35 to 60 wt % (and probably from 41 to 53, 56 or 60 wt %) of particles (i) which contain non-soap anionic surfactant, nonionic surfactant and water-soluble or insoluble detergency builder, (ii) from 15 to 40 wt % (and probably from 16 or 17 to 35 wt %) of material in the form of particles (ii) which are substantially free of surfactant, i.e. contain at least 95% of their own weight of water soluble material but contain no more than 5% of their own weight of organic surfactant, and (iii) from 0 to 50 wt % of further particulate ingredients, wherein the first said particles (i) contain at least 20% preferably at least 24% of their own weight of non-soap surfactant and the weight of anionic surfactant therein is from 1.5 to 5 times the weight of nonionic surfactant therein.

The particles (i) may be such as to be defined by reference to a test procedure described below. In such forms of the invention, the particles (i) contain non-soap anionic surfactant, nonionic surfactant, preferably soap and other water-soluble ingredients, wherein the particles (i) contain at least 20 wt % in total of the anionic and nonionic surfactants and a test tablet consisting of the said non-soap anionic surfactant, nonionic surfactant, and any soap in the same proportions, together with 15% by weight moisture has a breaking strength as herein defined of at least 0.04 MPa and a modulus as herein defined of not more than 10 MPa preferably not more than 8 MPa.

In a further aspect, this invention provides the use of a process as defined earlier to provide improvements in tablet strength and elasticity versus speed of disintegration.

In certain forms of the invention the mixture of the particles (i) and material (ii) provides (at least) a surface layer of the tablet and the step of compaction is carried out using a press with a mould consisting of a pluarlity of mould parts, some of which are relatively moveable, at least one of the mould parts bearing an elastomeric layer on a surface area which contacts the mixture.

Preferably such a layer has thickness of at least 0.3 mm, better 0.5 mm, even better over 1 mm.

We have found that by using mould parts which have such an elastomer layer, the penetration of water into the tablets on immersion is increased, thereby accelerating distintegration/dissolution of the tablets at the time of use.

As stated above, the pressure applied to bring about compaction into a tablet lies in a range from 3 to 35 MPa. Desirably, especially when mould parts carry an elastomer layer, the pressure is at least 4.0 or 4.5 MPa. A range up to 18, 20 or 25 MPa is generally suitable and the range may be narrower, e.g. up to 12 or 15 MPa.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each derived by compaction from a particulate composition. In a heterogenous tablet according to the present invention, each discrete region of the tablet will preferably have a mass of at least 5 gm.

In a heterogeneous tablet, at least one and possibly more of the discrete regions contains the mixed anionic and nonionic surfactants and detergency builder in accordance with the invention.

DRAWINGS

Embodiments of this invention and of apparatus for tablet manufacture and testing will be described by way of example with reference to the accompanying drawings in which.

MATERIALS AND OTHER FEATURES

Figure 1:
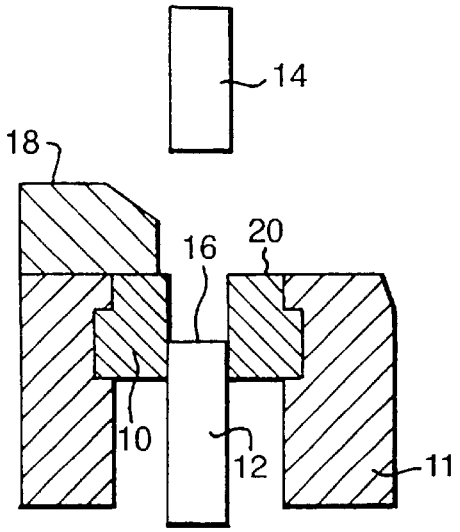
FIG. 1 is a vertical cross-section through a simple tablet press, illustrating its general arrangement.

Materials which may be used in tablets of this invention will now be discussed in more detail.

Anionic Surfactant Compounds

Synthetic (i.e. non-soap) anionic surfactants are well known to those skilled in the art. The anionic surfactant may comprise, wholly or predominantly, linear alkyl benzene sulphonate of the formula

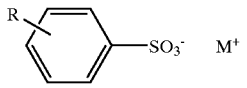

where R is linear alkyl of 8 to 15 carbon atoms and $M^+$ is a solubilising cation, especially sodium.

Primary alkyl sulphate having the formula $ROSO_3^-M^+$ in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to the required non-soap anionic surfactant. Examples are sodium soaps derived from the fatty acids from coconut oil, beef tallow, sunflower or hardened rapeseed oil. These may be formed by adding fatty acid and a base such as sodium carbonate to a slurry which is spray-dried to form the surfactant-rich base particles.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Detergency Builder

The mixture which is compacted to form tablets or tablet regions preferably includes water-soluble or water-insoluble detergency builder.

Water-soluble phosphorous-containing inorganic detergency builders include the alkali-metal orthophosphates, metaphosphates, pyrophosphates and polyphosphates. Specific examples of inorganic phosphate builders include sodium and potassium tripolyphosphates, orthophosphates and hexametaphosphates.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8–1.5Na_2O.Al_2O_3.0.8–6SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium alumino-silicates of this type are the well known commercially available zeolites A and X, the novel zeolite P described and claimed in EP 384070 (Unilever) which is also called zeolite MAP and mixtures thereof. Zeolite MAP is available from Crosfields under their designation Zeolite A24.

Conceivably, water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

The particles (i) may contain both water-soluble and water-insoluble detergency builders.

Non-phosphorous water-soluble builders may be organic or inorganic. Inorganic builders that may be present include alkali metal (generally sodium) carbonate; while organic builders include polycarboxylate polymers, such as—polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Proportions

Generally, a tablet or a region thereof made in accordance with this invention will contain overall from 2 or 5 wt % up to 40 or 50 wt % non-soap surfactant, and from 5 or 10 wt % up to 60 or 80 wt % detergency builder.

The concentration of non-soap anionic surfactant in the tablet or a region thereof will generally be at least one and a half times the concentration of nonionic surfactant. It is preferably from 3 wt % up to 30 or 40 wt % of the tablet or region. The concentration of nonionic surfactant is preferably from 2 to 15 wt % of the tablet or region thereof.

The quantity of soap in the tablet or region thereof is preferably from 0.1 or 0.2 up to 1% or 2% by weight of the tablet or region thereof. Higher proportions such as up to 4% are less preferred.

Where a tablet is heterogenous, these percentage ranges may apply to the overall composition of the tablet, as well as to at least one region of the tablet.

In certain forms of this invention, anionic non-soap surfactant, nonionic surfactant water-soluble detergency builder and other materials which may include soap are made into particles (i) such that the non-soap surfactant provides from 20 to 50% of the weight of these particles. Preferably the non-soap surfactant provides at least 24% of the weight of these particles, and more preferably at least 28%. When soap is present, it is desirably from 0.2 to 2%, and possibly more, up to 3% or 4% by weight of these particles, and in these particles the weight ratio of nonionic detergent to soap is preferably from 5:1 better 10:1 to 30:1.

Such particles may be made by spray drying, or by a granulation process. Preferably they contain water-soluble detergency builder in an amount which is from 30 to 80% of the weight of these particles (i) better 30 or 40 up to 60% of the weight of these particles.

Disintegration-promoting Material (ii)

In addition to the required particles containing surfactants and builder, a tablet or tablet region of this invention contains water-soluble material (ii) which serves to promote disintegration. Preferably this is provided as particles which are substantially free of organic surfactant.

One preferred possibility is that the said particles which promote disintegration are particles containing sodium tripolyphosphate with more than 50% of it (by weight of the particles) in the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 55% by weight of the tripolyphosphate in the particles. Other forms of sodium tripolyphosphate will usually be present to a lesser extent. Other salts may be included in the particles, although that is not preferred. A further preference is that the sodium tripolyphosphate is partially hydrated. The extent of hydration should be at least 1% by weight of the sodium tripolyphosphate in the particles. It may lie in a range from 2.5 to 4%, or it may be higher.

Suitable material is commercially available. Suppliers include Rhone-Poulenc, France and Albright & Wilson, UK.

"Rhodiaphos HPA 3.5" from Rhone-Poulenc has been found particularly suitable. It is a characteristic of this grade of sodium tripolyphosphate that it hydrates very rapidly in a standard Olten test. We have found that it hydrates as quickly as anhydrous sodium tripolyphosphate, yet the prehydration appears to be beneficial in avoiding unwanted crystallisation of the hexahydrate when the material comes into contact with water at the time of use.

Another possibility which can be used instead of tripolyphosphate, or in a mixture with it, is that these disintegration-promoting particles contain at least 50% of their own weight, better at least 80%, of a material which has a solubility in deionised water at 20° C. of at least 50 grams per 100 grams of water.

The said particles may provide material of such solubility in an amount which is at least 7 wt % or 12 wt % of the whole composition of the tablet or region thereof.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate trihydrate | 76 |
| Magnesium sulphate $7H_20$ | 71 |
| potassium acetate | >200 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 50% by weight of these particles.

Other Ingredients

Detergent tablets according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the tablet.

Preferred inorganic persalts are sodium perborate monohydrate and tetrahydrate, and sodium percarbonate. Bleach activators have been widely disclosed in the art. Preferred examples include peracetic acid precursors, for example tetraacetylethylene diamine (TAED), and perbenzoic acid precursors. The quaternary ammonium and phosphonium bleach activators disclosed in U.S. Pat. Nos. 4,751,015 and 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Bleach activator is usually present in an amount from 1 to 10% by weight of the tablet, possibly less in the case of a transition metal catalyst which may be used as 0.1% or more by weight of the tablet.

The detergent tablets of the invention may also contain one of the detergency enzymes well known in the art for their ability to degrade various soils and stains and so aid in their removal. Suitable enzymes include the various proteases, cellulases, lipases, amylases, and mixtures thereof, which are designed to remove a variety of soils and stains from fabrics. Detergency enzymes are commonly employed in the form of granules or marumes, optionally with a protective coating, in amount of from about 0.1% to about 3.0% by weight of the tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Antifoam materials in granular form are described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material.

It may also be desirable that a detergent tablet of the invention includes an amount of an alkali metal silicate, particularly sodium ortho-, meta- or disilicate. The presence of such alkali metal silicates may be advantageous in providing protection against the corrosion of metal parts in washing machines, besides providing some detergency building. Preferably the surfactant-rich particles contain from 5 to 15% silicate by weight of the particles. This improves the strength and free flow of these particles prior to tabletting.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

These various other ingredients may be present in the surfactant-rich particles or in the balance of the composition outside them. It is preferred that any bleach is contained in the balance of the composition outside the surfactant-rich particles.

Particle Size and Distribution

Preferably the particulate mixture of particles (i) and (ii) has an average particle size before compaction in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 550 g/liter, and perhaps at least 600 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Tableting

Tableting entails compaction of the particulate composition which is a mixture of the particles (i) and (ii). A variety of tableting machinery is known, and can be used. Generally it will function by stamping a quantity of the particulate composition which is confined in a mould.

Tableting may be carried out without application of heat, so as to take place at ambient temperature or at a temperature above ambient. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

If an elastomeric layer is provided on a mould part, ie a die, it may be a piece, such as a disc, cut from a sheet of elastomer and secured to the die surface with adhesive. Some elastomers can be applied as a coating on the die, but this is not preferred as a route for producing layers more than 0.5 mm thick.

Mould parts, to which an elastomeric layer is applied in accordance with this invention, will generally be metallic, most usually steel. Other rigid materials such as ceramics may possibly be used.

Adhesives suitable for securing an elastomer layer to a rigid mould surface include two-part epoxy resin and one-part cyanoacrylate types. Two-part epoxy resin adhesive is sold under the trade mark "Araldite" by Ciba-Geigy Plastics, Duxford, England.

Preferably the step of compaction is carried out using a press having a pair of dies which are moveable relatively towards and away from each other, at least one of the dies having an elastomeric surface layer on an area which contacts the composition (which layer preferably has a thickness of at least 0.3 mm at its periphery) wherein the periphery of the said area with elastomeric layer thereon is surrounded by a rigid rim.

This rigid rim surrounding the elastomer is preferably a metal rim integral with the main body of the die. The rim will protect the edge of the elastomer, and extend the working life of the die, thereby reducing costs and machine downtime.

Provision of a rigid rim around a piece of elastomer is subject to conflicting requirements. The rigid rim, which may well be metal, is part of the die face which contacts the detergent composition. There would be reason to fear the composition could adhere to this rim.

If the rim is narrow, there is less area to adhere to, but if the elastomer has significant thickness where it adjoins the rim, then making the rim narrow also reduces its mechanical strength especially if the elastomer layer has distinct thickness at its edge adjacent the rim.

We have found that a narrow rim, which is however wide enough to create a visible indentation in the tablet, can be strong enough to be useful, even when surrounding elastomer of distinct thickness at its edge, without re-creating the adhesion problem.

Moreover, a rim can also serve to retain a piece of elastomer in place on the die, making it unnecessary to mould or glue the elastomer in place, or allowing it to be glued with an adhesive which would not be strong enough in the absence of the rim.

This greatly facilitates use of an elastomer layer on dies because the elastomer can be made as an insert to go within the rim. As tablets are stamped the elastomer will wear, but worn elastomer can easily be removed and replaced with a new insert when required. An elastomer insert preferably has a thickness of at least 0.3 mm, better at least 0.5 or 1 mm over its entire area. To assist in retaining the elastomer, the rim is preferably undercut. Easy replacement of worn elastomer gives an advantage of keeping short the periods of machine downtime when changing the elastomer.

A die may have a single area with an elastomeric surface layer thereon, surrounded by a rigid rim at the edge of the die. It is also conceivable that there could be subdivision into a plurality of adjacent areas of elastomeric surface layer whose adjoining edges are separated by a shared rim portion.

This invention is applicable to compacted tablets of detergent composition for fabric washing. These will generally contain at least 5 wt % of organic surfactant together with at least 5 wt % of detergency builder.

In a further aspect, the present invention provides the use of an elastomeric layer, preferably more than 0.5 mm thick on a surface area of at least one mould part in a press for compacting particulate detergent composition into tablet form, which surface area contacts the composition during compaction—in order to enhance the penetration of water through the tablet surface on immersion; further characterised in that the area with an elastomeric layer thereon is surrounded by a rigid rim.

When tablets are stamped, the rigid rim will form an indentation around the area of the tablet surface contacted by elastomer. The indentation will be less permeable than the face which it surrounds, as a consequence of being stamped by the rigid rim. However, this can be accepted without significant harm to the rate of dissolution/disintegration of the tablet, because the surface area of this indentation can be small in proportion to the overall surface area of the tablet.

The face of a rim which contacts the mixture of particles (i) and (ii) during compaction desirably has a width of at least 0.5 mm, preferably at least 1.0 mm, but not more than 2.5 mm. Preferably the width is not more than 2.0 mm. A range of 1.3 to 1.9 mm has been found particularly suitable.

Correspondingly, the width of an indentation in the tablet surface will desirably lie in the range from 0.5 mm to 2.5 mm, preferably from 1.0 or 1.3 to 1.9 or 2.0 mm.

The surface area of a die which comes into contact with detergent composition may lie in a range from 750 to 4000 $mm^2$. Typically a tablet may be cylindrical, for example with a radius of 16 to 35 mm, and then the radial extent of a rim and the indentation formed by it may be from 0.5 to 2.5 mm. Consequently the indentation may occupy less than 20% of the area of the face including the surrounding indentation.

The invention can be put into effect using a conventional stamping press as illustrated in FIG. 1 of the accompanying drawings. This tabletting press incorporates a tubular sleeve 10 into which fit a lower punch 12 and an upper punch 14. The punches are also referred to as dies. The sleeve 10 defines a mould cavity closed at its bottom by the lower punch 12. In use a particulate composition is supplied to this cavity by means of a filling shoe 18 which slides on the upper surface 20.

Initially the filling shoe delivers a particulate composition to fill the cavity 16 within sleeve 10 above the lower punch 12.

Next, the filling shoe withdraws to the position shown in FIG. 1 and the upper punch 14 is pressed down into the cavity within sleeve 10 thus compacting the particulate composition in the cavity to form a shaped tablet. Subsequently the upper punch is raised and the lower punch 12 is also raised to eject the tablet.

In accordance with this invention, the upper punch 12 and the lower punch 14 each have an elastomeric layer over most of their faces which come into contact with the detergent composition.

The sleeve 10, which also forms part of the mould, is made of steel and is not surfaced with elastomer. The punches 12,14 make sliding contact with this sleeve, as do tablets compacted in the mould.

Figure 2:
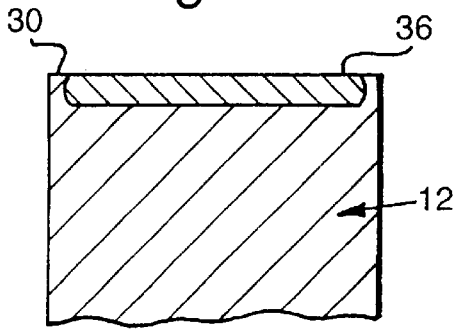
FIG. 2 is a schematic cross section of part of a die with an elastomeric insert in place.
Figure 3:
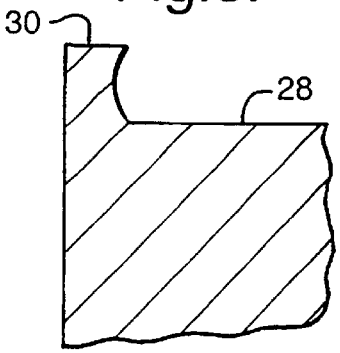
FIG. 3 is an enlarged detail without the insert.

As shown by FIGS. 2 and 3, each of the punches 12, 14 has a flat end face 28 surrounded by a rim 30 at the circumference of the punch and integral with it.

As best seen in FIG. 3, the rim 30 is undercut at its inside face 32. The elastomer is a pre-formed insert 36 about 2 mm thick. It is shown here as laminar, but it may be made thicker at its circumference than at its centre, to produce tablets with slightly domed faces. As shown in FIG. 2, such an insert can be pre-fitted into the space within the rim 30 so that it lies against the face 28 and is retained, without adhesive, by the undercut rim 30. The edge of the insert 36 closely abut the face 32 of rim 30.

During the stamping of tablets using such dies, the elastomer inserts will wear slowly. When necessary they can easily be replaced with new inserts.

Figure 4:
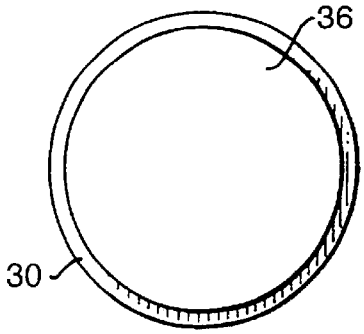
FIG. 4 is a face view of the die.
Figure 5:
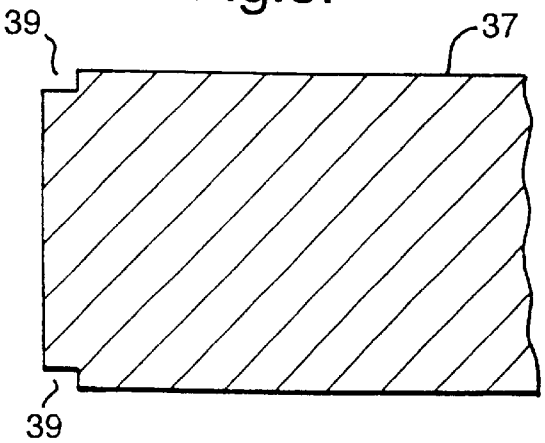
FIG. 5 is an enlarged cross section of part of a tablet.

When tablets are stamped, their cylindrical faces will be defined by the sleeve 10. Their end faces 37 which may be slightly domed, will be defined by the elastomer inserts 36 in the dies 12 and 14. At the circumference of each end face 37, the rigid rim 30 will create a small indentation 39 as shown in FIG. 4. This will occupy only a small fraction of the surface area of the end face 37. Because of this, a lower permeability, consequent on pressure from the rigid rim 30 rather than the elastomer 36, will have negligible effect on the speed with which tablets take up water, then disintegrate, at the time of use.

Figure 6:
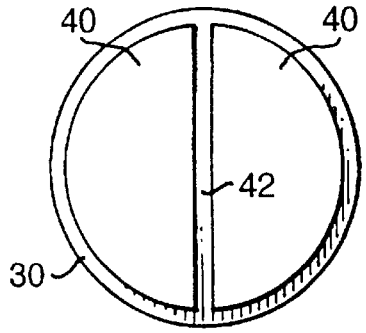
FIG. 6 is a face view of a different die.

FIG. 6 shows a variation. Instead of a single disc of elastomer 36 within rim 30, there are two D-shaped pieces of elastomer 40. Their adjacent straight edges abut a bar 42 which extends diametrally across the face of the die. The exposed face of this bar is level with the exposed face of the circumferential rim 36, which it joins at each end. This bar is undercut at both sides. Consequently each of the D-shaped pieces of elastomer is surrounded by a rim consisting of half the circumferential rim 30 plus the bar 40.

It is conceivable, but not preferred, that the elastomeric surface layer and surrounding rim could be provided on one die of a pair, or on a stationary counter member facing a single die, yet not on the die. Such arrangements would be expected to lead to asymmetric tablets in which one face was more permeable than the opposite face. This would still give the benefit of enhanced water penetration into the tablet, albeit through one, not both, faces.

Elastomers

Preferably the elastomer surface layer on one or more dies has a thickness at its periphery or over its whole area of at least 300 $\mu$m, better at least 400 $\mu$m or at least 500 $\mu$m. If provided as an insert, the elastomer preferably has a thickness at its periphery or over its entire area of at least 1 mm.

Elastomers are polymers which are deformable, but return to approximately their initial dimensions and shape upon release of the deforming force. Generally they are polymers with long flexible chains, with some cross-linking between chains so as to form a cross-linked network structure. The network structure restrains the movement of the macromolecular chain molecules and as a result recovers rapidly after deformation.

The term "elastomeric" includes materials as defined in ISO (International Standard Organisation) 1982 as an "elastomer", or "rubber". Also included in the definition of "elastomeric" materials according to the invention are thermoplastic elastomers and copolymers and blends of elastomers, thermoplastic elastomers and rubbers.

At low temperature, generally well below 0° C., elastomers are hard and brittle. Then with increasing temperature an elastomer goes through a rubbery phase after softening and retains its elasticity and elastic modulus until its decomposition temperature is reached. The material should of course be in its rubbery state at the operating temperature of the press.

Preferably the elastomeric material according to the invention is selected from those classes described in American Society for Testing and Materials D1418 which include:

1. Unsaturated carbon chain elastomers (R Class) including natural rubbers and butadiene acrylonitrile copolymer, e.g. "Perbunan" ex Bayer.
2. Saturated carbon chain elastomers (M Class) including ethylene-propylene types, e.g. "Nordel" ex DuPont and fluorine containing types, e.g. "Viton" ex DuPont.
3. Substituted silicone elastomers (Q Class), e.g. as available from Dow Corning.
4. Elastomers containing carbon, nitrogen and oxygen in the polymer chain (U Class), e.g. polyurethane ex Belzona.

Additional materials, for example fillers, can be incorporated in the elastomeric material to modify its mechanical and processing properties. The effects of filler addition depends on the mechanical and chemical interaction between the elastomeric material and the filler.

Fillers can be used to improve tear resistance for example. Suitable fillers include carbon blacks; silicas; silicates; and organic fillers such a styrene or phenolic resins. Other optional additives include friction modifiers and antioxidants.

An elastomeric insert is preferably made by moulding the elastomer in a separate mould. Technology for moulding elastomers to shape is well known. Possibly an elastomeric insert could be cut from a sheet of elastomer, but this is less preferred.

Tablet Size and Density

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/liter up to 1300 gm/liter and possibly up to 1400 gm/liter or even somewhat more (but the tablet should have some porosity even if density is high). The tablet density may well lie in a range up to no more than 1250 or even 1200 gm/liter.

Porosity

The step of compacting the particles reduces the porosity of the composition. Porosity is conveniently expressed as the percentage of volume which is air.

The air content of a tablet can be calculated from the volume and weight of the tablet, provided the air-free density of the solid content is known. The latter can be measured by compressing a sample of the material under vacuum with a very high applied force, then measuring the weight and volume of the resulting solid.

The percentage air content of the tablet varies inversely with the pressure applied to compact the composition into tablets while the strength of the tablets varies with the pressure applied to compact them into tablets. Thus the greater the compaction pressure, the stronger the tablets but the smaller the air volume within them.

The invention may be applied when compacting particulate detergent composition to give tablets with a wide range of porosities. Specifically included among possible porosities is a porosity of 17 or 20 better 25% up to 35% air by volume in the tablet.

Tablets of this invention may have porosity and surface permeability such that at least 65% of the void space within the tablet is filled with water within 30 seconds, upon partial immersion such that three quarters of the tablet surface is in contact with water.

Water Uptake

The speed with which water can penetrate into a tablet, which indicates whether interior porosity is open to the exterior through a permeable surface layer, can be assessed by a test of tablet wetting on partial immersion.

The following procedure is suitable: A tablet is weighed, then supported on a wire mesh support within a container which is larger than the tablet. (The wire mesh support exposes more of the tablet surfaces than exposed than would be the case if the tablet was simply resiting on the base of the container.) Demineralised water, with coloured ink or dye dissolved in it, is poured into the container until it covers three quarters of the tablet surface. After 30 seconds the tablet is lifted out of the water, held for 5 seconds to allow water to drain off its surfaces, and weighed again. The increase in tablet weight is of course the weight of water taken up, and a measure of the speed with which water is taken up through capillary action. This volume of water is then expressed as a percentage of the air volume within the tablet.

The part of the tablet which was not immersed in water is inspected visually. If the void space within the tablet has become completely (or nearly completely) filled with water, then this part of the tablet will have become coloured with the dye in the water. If water has not penetrated fully into the tablet, the immersed surface of the tablet will be coloured by the dye, but part of the surface which remained dry will also remain free of dye.

Figure 7:
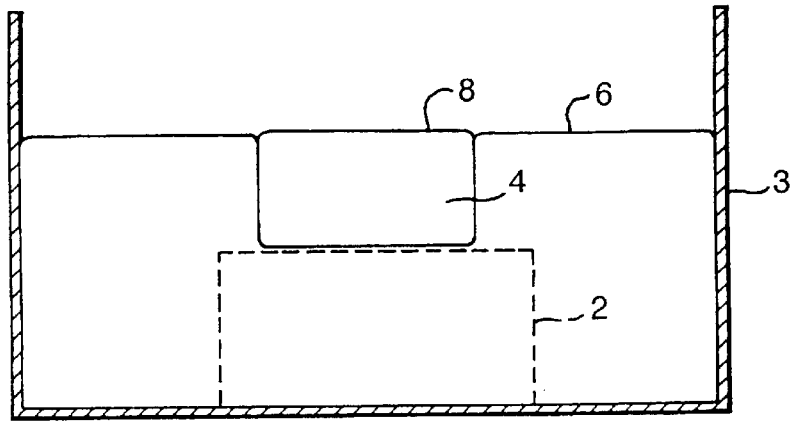
FIG. 7 illustrates a test procedure for water uptake.

FIG. 7 of the drawings illustrates the application of this test to a cylindrical tablet with a radius of 22 cm and a height of 20 cm.

A cylindrical dish 3 is used. A piece of wire mesh, aperture width 0.5 cm, is cut and shaped to provide a stand 2 within the dish. The tablet 4 for test is weighed and placed so that one flat face rests on this stand. Water containing a trace of black ink is poured into the dish almost up to a level 6, very close to the upper flat face 8 of the tablet. This face is approximately 25% of the tablet surface and remains exposed to air.

After a set time, usually 30 seconds, the tablet is removed, allowed to drain, and re-weighed to determine the weight of water taken up. (A qualitative indication, if the pores within the tablet did not fill completely with water, is that a circle at the centre of the face 8 of the tablet retains the original white colour of the tablet, while the rest of the tablet has the black colour of the ink).

It may be possible to support tablets in more than one orientation for partial immersion. If so, the orientation found to give greatest water uptake should be adopted for the test of wetting.

In practice, the extent of tablet wetting is not greatly affected by variation in the percentage surface area exposed to water, so that a useful result can be obtained when the percentage of the tablet surface covered by the water is anywhere from 70 to 80%.

It is desirable that in this test, at least 65%, better at least 80% of the void space within the tablet is filled with water within 30 seconds.

We have tested the speed of disintegration of tablets by means of a test procedure in which a tablet was placed on a plastic sieve with 2 mm mesh size which is immersed in 9 liters of demineralised water at ambient temperature of 20° C. The water conductivity is monitored until it reached a constant value. The time for dissolution of the tablets is taken as the time ($T_{90}$) for change in the water conductivity to reach 90% of its final magnitude.

Figure 8:
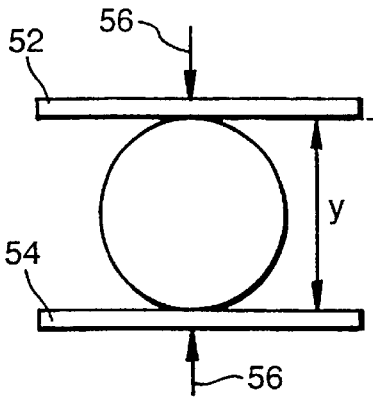
FIG. 8 shows a cylindrical tablet when first contacted by the platens of a materials testing machine.
Figure 9:
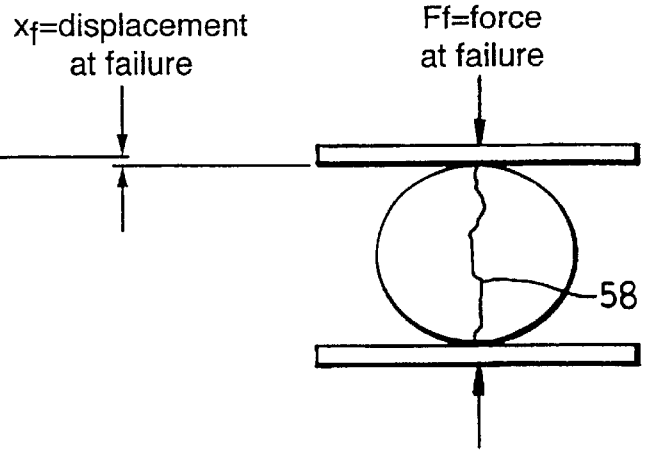
FIG. 9 shows the tablet at the point of failure, and FIG. 10 diagrammatically illustrates the form of a graph obtained during testing.

We have tested tablet strength by a procedure illustrated by the accompanying drawings in which a cylindrical tablet 50 is compressed radially between the platens 52,54 of a materials testing machine until the tablet fractures. At the starting position shown in FIG. 8, the platens 52,54 contact the tablet but do not apply force to it. Force is applied, as indicated by the arrows 56 to compress the tablet. The testing machine measures the applied force (F), and also the displacement (x) of the platens towards each other as the tablet is compressed. The distance (y) between the platens before force is applied, which is the diameter of the tablet, is also known. At failure, illustrated in FIG. 9 the tablet cracks (e.g. as shown at 58) and the applied force needed to maintain the displacement drops. Measurement is discontinued when the applied force needed to maintain the displacement has dropped by 25% from its maximum value.

Figure 10:
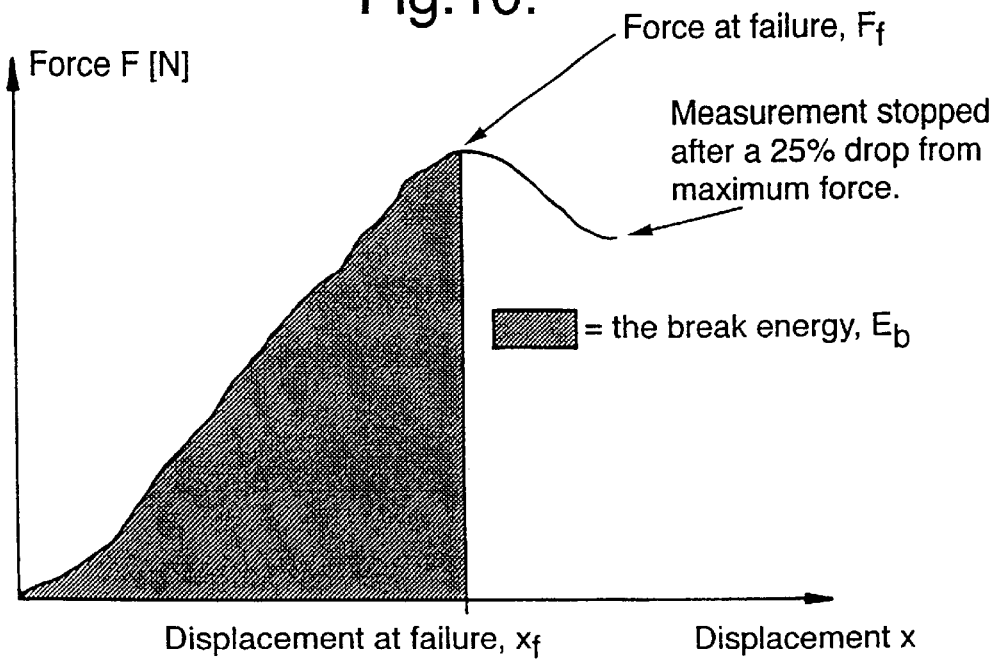

A graph of force (F) against displacement (x) has the form illustrated by FIG. 10. The maximum force is the force at failure ($F_f$). From this measurement of force a test parameter called diametral fracture stress, which we have used in the past, can be calculated using the equation $$\sigma = \frac{2F_f}{\pi Dt}$$

where σ is the diametral fracture stress in Pascals, $F_f$ is the applied force in Newtons to cause fracture, D is the tablet diameter in meters and t is the tablet thickness in meters.

The force at failure divided by the area of a diametral plane through the tablet (approximately the area of the crack 58) is the breaking strength, with units of Pascals.

The break energy is the area under the graph of force against displacement, up to the point of break. It is shown shaded in FIG. 2 and is given by the equation:

$$E_b = \int_0^{x_f} F(x)dx$$

where $E_b$ is the break energy in joules, x is the displacement in meters,

F is the applied force in Newtons at displacement x and $x_f$ is the displacement at failure.

The displacement at failure relative to the tablet diameter is the relative displacement $x_f/y$.

Breaking strength divided by relative displacement is a modulus, whose value is inverse to tablet elasticity.

The surfactant mixture used in these particles can be tested mechanically in directly analogous manner to the testing of tablets, discussed above. To do this a mixture of the non-soap surfactants and any soap is made on a small scale, and cast into cylindrical form or some other shape from which a cylinder can be cut. If necessary this is dried to reduce the water content to 15% by weight (approximating to 5% moisture in the particles which contain this surfactant mixture). Next, it is tested on a materials testing machine in the manner described above for testing of tablets. This mechanical testing procedure can also be applied to tablets made from the surfactant-rich particles alone.

We have found that the effect of anionic surfactant in these particles is to enhance tablet elasticity without much effect on magnitude of the force to cause fracture. Nonionic surfactant tends to have some opposite effect. Soap when present, cooperates with the nonionic surfactant to reduce mobility of the nonionic surfactant and to increase tablet strength (as measured by force to cause failure).

By using sufficient quantities of anionic non-soap surfactant, nonionic surfactant and preferably soap we have found that it is possible to achieve adequate strength and elasticity of a test tablet which in turn signifies that the same mixture will give tablets with good strength and elasticity.

Breaking strength is desirably at least 0.04 MPa preferably at least 0.05 MPa. The modulus is desirably no more than 10 MPa preferably no more than 8 or even 5 MPa.

We have observed that a mixture of alkylbenzene sulphonate and nonionic surfactant in ratio 1.16:1 gave a modulus of about 15 MPa but when the proportions were changed to 2.2:1 the modulus dropped dramatically to about 4.0 to 4.5 MPa, indicating greater elasticity, with very little change in force at failure.

EXAMPLE 1

Tablets for use in fabric washing were made, starting with a spray-dried base powder of the following composition:

| Ingredient | PARTS BY WEIGHT |
|---|---|
| Sodium linear alkylbenzene sulphonate | 11.0 |
| $C_{13-15}$ fatty alcohol 7EO | 2.4 |
| $C_{13-15}$ fatty alcohol 3EO | 2.3 |
| Sodium tripolyphosphate* | 18.0 |
| Sodium silicate | 4.0 |
| Soap | 0.21 |
| Acrylate/maleate copolymer | 1.5 |
| Sodium sulphate, moisture and minor ingredients | balance to 45 |

*Added to the slurry as anhydrous sodium tripolyphosphate containing at least 70% phase II form.

This powder was then mixed with other ingredients as tabulated below. These included particles of sodium tripolyphosphate specified to contain 70% phase I form and contain 3.5% water of hydration (Rhodia-Phos HPA 3.5 available from Rhone-Poulenc).

| Ingredient | % by weight |
|---|---|
| Base powder | 45 |
| Sodium percarbonate granules | 15 |
| TAED granules | 3.4 |
| Anti-foam granules | 3.2 |
| Perfume, enzymes and other minor ingredients | 3.5 |
| Rhodiaphos HPA3.5 tripolyphosphate | 30 |
| Sodium carbonate | — |

40 g portions of this particulate composition were made into cylindrical tablets of 44 mm diameter, using an automated industrial press stamping about 4000 tablets per hour. The press was fitted with punches having elastomer inserts about 2 mm thick within a surrounding rim, generally as described and shown with reference to FIGS. 2 to 4 of the drawings.

The press was set to apply compaction force of approximately 10 KN corresponding to a pressure of about 6 or 7 MPa which was sufficient to produce tablets with a diametral fracture stress of about 25 KPa.

It was found that the press could be run for several hours without any significant quantity of detergent composition adhering to the punches.

EXAMPLE 2

Tablets for use in fabric washing were made, starting with a granulated base powder of the following composition:

| | % by weight |
|---|---|
| Coconut alkyl sulphate | 20.33 |
| Nonionic detergent ($C_{13-15}$ fatty alcohol 7EO) | 11.09 |
| Soap | 3.60 |
| Zeolite A24 | 42.42 |
| Sodium carboxymethyl cellulose | 1.68 |
| Sodium carbonate | 5.11 |
| Sodium citrate dihydrate | 6.37 |
| Moisture and other minor ingredients | 9.4 |

This powder were mixed with other detergent ingredients as tabulated below.

| | % by weight |
|---|---|
| Base powder | 50.0 |
| Perborate monohydrate | 11.2 |
| TAED (83% active) granules | 4.35 |
| Phosphonate | 0.60 |
| Sodium carbonate | 2.0 |
| Na-disilicate (80%) | 3.7 |
| Antifoam granules | 2.5 |
| Fluorescer granules (15% active) | 1.0 |
| Acrylate maleate copolymer | 1.0 |
| Enzymes | 0.74 |
| Perfume | 0.45 |
| Sodium acetate trihydrate | 22.5 |

The resulting composition was made into tablets using a press fitted with punches generally as described and illustrated with reference to FIGS. 2 to 4 of the drawings. For stamping these tablets the press was set to apply a force of about 25 KN so that the compaction pressure was approximately 15 to 17 MPa, leading to tablets with a diametral fracture stress in a range from 30 to 45 KPa.

What is claimed is:

1. A process for the manufacture of a detergent tablet which comprises mixing (i) particles which comprise non-soap organic surfactant, with (ii) a material which is other than soap or organic surfactant and which has a solubility in water of at least 10 gm/liter at 20° C. followed by compacting the mixture into a tablet or a region of a tablet using an applied pressure in a range from 3.0 to 35 MPa, said material (ii) comprising from 15 to 40% by weight of the mixture of (i) and (ii) and being selected from the group consisting of a compound with a water-solubility exceeding 50 grams per 100 grams water; sodium tripolyphosphate containing at least 50% of its own weight of the phase I anhydrous form, and mixtures thereof, said particles (i) containing from 80 to 100% by weight of all the organic surfactant in the tablet or region thereof, from 25 to 80% of their own weight of water-soluble or water-insoluble detergency builder and from 20 to 50% of their own weight of non-soap organic surfactant.

2. A process according to claim 1 wherein the particles (i) provide from 25 to 85% by weight of the mixture.

3. A process according to claim 2 wherein the particles (i) provide from 41 to 56% by weight of the mixture.

4. A process according to claim 1 wherein the particles (i) contain both non-soap anionic and nonionic surfactants in a weight ratio from 5:1 to 1.5:1.

5. A process according to claim 1 wherein the material (ii) comprises one or more of sodium citrate dihydrate, anhydrous sodium acetate and sodium acetate trihydrate.

6. A process according to claim 1 wherein the mixture contains (i) from 35 to 60% by weight of particles (i) which contain non-soap anionic surfactant, nonionic surfactant and water-soluble or insoluble detergency builder, (ii) from 15 to 40% by weight of material in the form of particles (ii) which contain at least 95% of their own weight of water soluble material but contain no more than 5% of their own weight of organic surfactant, and (iii) from 0 to 50% by weight of further particulate ingredients, wherein the first said particles (i) contain at least 20% of their own weight of non-soap surfactant and the weight of anionic surfactant therein is from 1.5 to 5 times the weight of nonionic surfactant therein.

7. A process according to claim 1 wherein the compaction pressure lies in a range from 4.0 to 25 MPa.

8. A process according to claim 1 wherein the mixture contains (i) from 41 to 56% by weight of particles (i) which contain from 25 to 80% of their own weight of water-soluble or water-insoluble detergency builder and from 20 to 50% of their own weight of non-soap organic surfactant, (ii) from 15 to 40% by weight of material in the form of particles (ii) which contain at least 95% of their own weight of water-soluble material but contain no more than 5% of their own weight of organic surfactant and (iii) from 0 to 50% by weight of further particulate ingredients wherein the weight of anionic non-soap surfactant in the first said particles (i) is from 1.5 to 5 times the weight of nonionic surfactant therein.

9. A process according to claim 8 wherein the compaction pressure lies in a range from 4.5 to 25 MPa.

10. A process according to claim 1 wherein the sodium tripolyphosphate is partially hydrated so as to contain water of hydration in an amount which is at least 1% by weight of the sodium tripolyphosphate.

* * * * *